US010841717B2

(12) United States Patent
Meyer et al.

(10) Patent No.: US 10,841,717 B2
(45) Date of Patent: Nov. 17, 2020

(54) SIGNAL GENERATOR AND METHOD FOR MEASURING THE PERFORMANCE OF A LOUDSPEAKER

(71) Applicant: Meyer Sound Laboratories, Incorporated, Berkeley, CA (US)

(72) Inventors: John D. Meyer, Berkeley, CA (US); Roger Schwenke, Albany, CA (US); Toban A. Szuts, Oakland, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 0 days.

(21) Appl. No.: 16/443,552

(22) Filed: Jun. 17, 2019

(65) Prior Publication Data

US 2019/0394590 A1 Dec. 26, 2019

Related U.S. Application Data

(60) Provisional application No. 62/688,208, filed on Jun. 21, 2018.

(51) Int. Cl.
*H04R 29/00* (2006.01)

(52) U.S. Cl.
CPC ..... *H04R 29/001* (2013.01)

(58) Field of Classification Search
None
See application file for complete search history.

(56) References Cited

U.S. PATENT DOCUMENTS

| | | | | |
|---|---|---|---|---|
| 4,855,944 | A | 8/1989 | Art | |
| 8,340,210 | B2 | 12/2012 | Haddad | |
| 8,571,225 | B2 | 10/2013 | Botti et al. | |
| 9,277,341 | B2 | 3/2016 | Mihelich et al. | |
| 9,496,903 | B2 | 11/2016 | Mege et al. | |
| 9,596,553 | B2 * | 3/2017 | Devantier | H04R 29/001 |
| 2013/0088277 | A1 | 4/2013 | Gontcharov | |
| 2015/0023509 | A1 * | 1/2015 | Devantier | H04R 29/001 381/58 |
| 2015/0155842 | A1 * | 6/2015 | Shuttleworth | H03G 7/002 381/98 |
| 2016/0150336 | A1 | 5/2016 | Silzle et al. | |

* cited by examiner

*Primary Examiner* — Paul W Huber
(74) *Attorney, Agent, or Firm* — Beeson Skinner Beverly, LLP

(57) ABSTRACT

A noise generator and method are provided for generating a test signal for measuring the performance of a loudspeaker over an operating broad band of frequencies ranging from low to high frequencies. A broadband random noise source is provided for generating broadband noise over the operating broad band of frequencies of the loudspeaker, and an impulsive noise source is additionally provided for generating random impulses of noise. The broadband noise and the randomly generated noise impulses are equalized to produce a composite noise signal having a desired crest factor as a function of frequency.

21 Claims, 2 Drawing Sheets

SIGNAL GENERATOR AND METHOD FOR MEASURING THE PERFORMANCE OF A LOUDSPEAKER

CROSS-REFERENCE TO RELATED APPLICATIONS

This application claims the benefit of U.S. Provisional Patent Application No. 62/688,208 filed Jun. 21, 2018, which is incorporated herein by reference.

BACKGROUND

The present invention relates to sound reproduction and loudspeakers used in sound reproduction, and more particularly relates to the use of test signals to evaluate the performance of loudspeakers.

Test signals are widely used by audio professionals to evaluate loudspeaker performance. Heretofore, such test signals, which include white noise, pink noise, and sine sweeps, all have a relatively constant and relatively low crest-factor as a function of frequency. The difficulty with this is that the crest factors for most live signals that microphones and loudspeakers need to reproduce (speech and music) are not constant but rather increase with frequency, while having an average level that decreases with frequency. As a result, the tests performed by conventional test signals fail to produce test results that correctly reflect how the loudspeaker will perform under real life operating conditions.

The present invention overcomes the above drawbacks with conventional test signals by providing the facility to produce a test signal whose average level and crest factor more closely approximates real signals.

SUMMARY OF THE INVENTION

In one aspect of the invention, a noise generator is provided for generating a test signal for measuring the performance of a loudspeaker over an operating broad band of frequencies ranging from low to high frequencies. The noise generator is comprised of a broadband random noise source for generating broadband noise over the operating broad band of frequencies of the loudspeaker, and an impulsive noise source for generating random impulses of noise. Means are provided for equalizing the broadband noise generated by the broadband noise generating means, and for separately equalizing the random noise impulses. The equalized broadband noise and the equalized randomly generated noise impulses are combined into a composite noise signal that becomes the test signal.

In accordance with the invention, the broadband noise and the randomly generated noise impulses are equalized to produce a composite noise signal having a desired crest factor as a function of frequency. In particular, the two separate noise sources can be equalized to produce a composite noise signal having an average level and a crest factor as a function of frequency that approximates real signals. To achieve this objective, the means for equalizing the broadband noise generated by the broadband noise source is configurable to reduce the average level of broadband noise at high frequencies within the operating broad band of frequencies of the loudspeaker. Both the broadband noise and the randomly generated noise impulses can in turn be equalized to produce a composite noise signal having a crest factor that at high frequencies is larger than the crest factor of the broadband noise alone. Preferably, the broadband noise source generates pink noise and the means for equalizing the noise impulses generated by the impulsive noise source is configured to reduce the low frequency energy level of the noise impulses.

In a further aspect of the invention the reduction in the average level of the noise impulses is achieved by controlling the average rate at which random noise impulses are generated while preserving the randomness of the rate.

The invention is also directed to a method of measuring the performance of a loudspeaker over an operating broad band of frequencies ranging from low to high frequencies, comprising the steps of generating broadband noise over the operating broad band of frequencies of the loudspeaker, randomly generating noise impulses, separately equalizing the broadband noise and random noise impulses, combining the equalized broadband noise and equalized random noise impulses into a composite test signal having a crest factor, and driving the loudspeaker to be measured with the composite test signal. In accordance with this method, the broadband noise and random noise impulse are equalized to produce a crest factor for the test signal that increases with frequency.

DESCRIPTION OF THE ILLUSTRATED EMBODIMENT

The crest factor of a signal is defined as the ratio of peak value to the rms value of the signal's waveform. The crest factor for a sinusoidal waveform, such as that which a pure resistive load would draw, is 1.414 since the peak of a true sinusoid is 1.414 times the rms value. Crest factors in noise signals play an important role in determining whether a noise signal used to evaluate the performance of a loudspeaker accurately does so for real life operating conditions. Test signals that do not have crest factors and characteristics that cause a loudspeaker to respond as it would with real live signals, such as are present in speech and music, are not going to provide an accurate indication of the loudspeaker's true performance with real signals.

Figure 1:
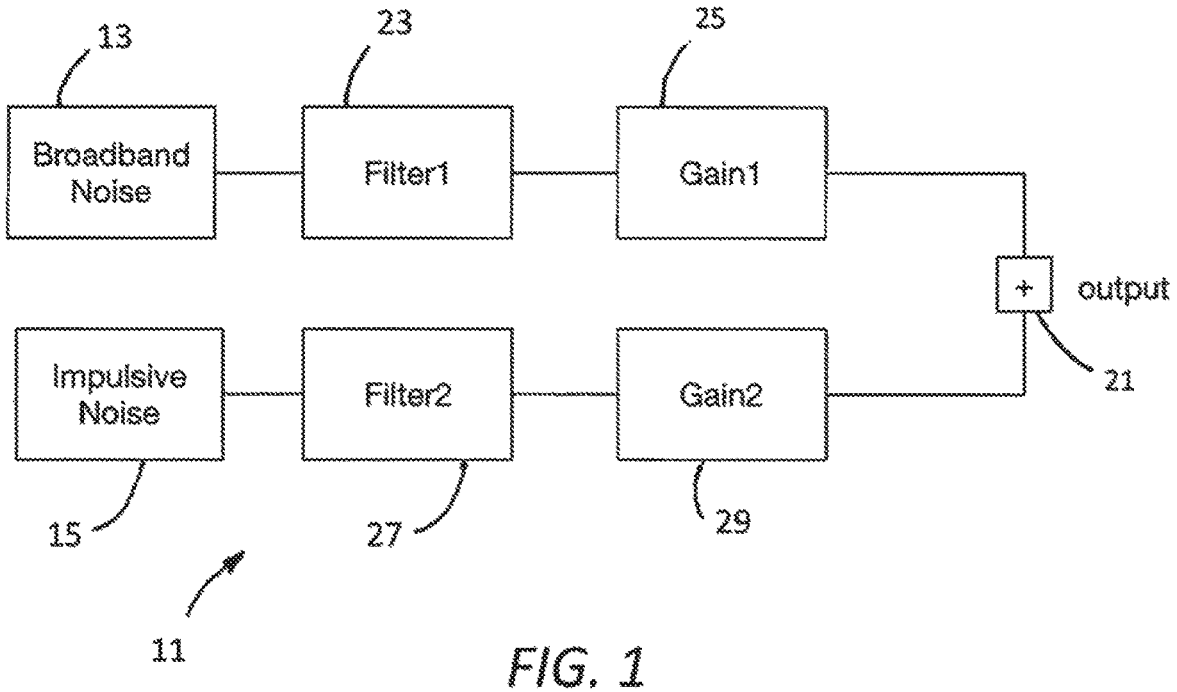
FIG. 1 is a function block diagram illustrating a noise generator in accordance with the invention.

FIG. 1 illustrates a noise generator in accordance with the invention. The noise generator, denoted by the numeral 11, has two noise sources, a source of broadband noise 13 and a source of impulsive noise 15. The source of broadband noise produces noise over the operating broad band of frequencies, typically 20 Hz to 20,000 Hz, and preferably produces pink noise across this frequency spectrum, such that there is an equal amount of energy in each octave of the noise signal. Alternatively, the broadband noise source could generate white noise which is subsequently passed through a "pink filter" for converting the white noise into pink noise.

The source of impulsive noise produces impulses that occur at random intervals. Preferably, means are provided, suitably within the impulse noise source but possibly external to this noise source, for controlling the average rate at which noise impulses are produced. The average pulse (or firing) rate could, for example, be 6 pulses per second, which can be adjusted up or down. However, while the average pulse rate can be fixed, it is understood that the time interval between pulses firings remains random. It is important that this randomness be preserved. As further described below, the ability to adjust the average firing rate of the impulse noise source will provide another tool for achieving desired crest factor characteristics in the output of the noise generator.

It is seen that broadband noise source 13 and impulsive noise source 15 are situated in different noise signal paths, with the broadband noise generator being in a first noise signal path 17 and the impulsive noise generator being in a second noise signal path 19. The output of noise generator 11 is a composite signal produced by summing these two noise signals together, as denoted by the summation point 21 illustrated in FIG. 1. However, prior to summation, the noise signals are separately processed to achieve desired characteristics in the composite noise signal, including desired levels at low frequencies and desired crest factors at high frequencies (as well as at low frequencies) that better match the characteristics of the live sound that a loudspeaker will be called upon to reproduce.

In the illustrated embodiment, processing the separate noise signals in each signal path is achieved by filters and gain controls in the signal paths, which apply separate equalizations and provide separate gain controls to the two noise signals. As shown in FIG. 1, the first noise signal path 17 is seen to include a first filter 23 (Filter 1) and a first gain control 25 (Gain 1), and the second noise signal path 19 is seen to include a second filter 27 (Filter 2) and a second gain control 29 (Gain 2). On the broadband noise side, Filter 1 could suitably be a second order shelf filter with a low Q, or a low pass filter with a low Q. On the impulse noise side, Filter 2 could suitably be implemented with a high pass filter to remove low frequencies and a shelf filter to very gradually increase levels at high frequencies. The separate gain controls 25, 29 can be used in conjunction with the filters 23, 27 to achieve to achieve desired crest factor characteristics in the composite noise signal at the noise generator output 21. It will be appreciated that the invention is not limited to such filter and gain control implementations, and that other implementations could be used.

As to Filter 1, its general purpose is to reduce the average level of the broadband noise at high frequencies, generally above 500-1000 Hz. The general purpose of Filter 2 is to reduce the low frequency energy in the impulse noise, generally below 500-1000 Hz. Most suitably, Filters 1 and 2 and Gains 1 and 2 are configured such that the crest factor of the composite noise signal output gradually increases with frequency to relatively high crest factors at the highest frequencies. For example, it is contemplated that the filters and gain controls in each signal path can be suitably configured and adjusted to achieve crest factors in the range of 20 dB to 30 dB at the highest frequencies, for example, above about 16 kHz. At low frequencies, crest factors can be achieved that are relatively low. For example, it may be desirable to provide for crest factors in the range of 9 dB to 13 dB. Particular low to high frequency crest factor characteristics can be established in accordance with the contemplated use of the loudspeaker under test, and, as an example, could be made to gradually increase from less than 10 dB to a crest factor ranging up to 30 dB over the frequency range of the loudspeaker.

Thus, it is seen that invention is basically a test signal which is the sum of two signals which have separate equalizations applied to them, and which preferably also have separate gain controls. The two signals are: a broadband continuous noise, and an impulsive source which fires randomly but at a prescribed average rate. The average firing rate of the impulsive noise source, the equalization of the two sources, and the relative level of the two sources are chosen to produce a composite signal which, among other things, most suitably has a crest factor that is not constant and that at high frequencies is relatively large compared to conventional test signals.

Figure 2:
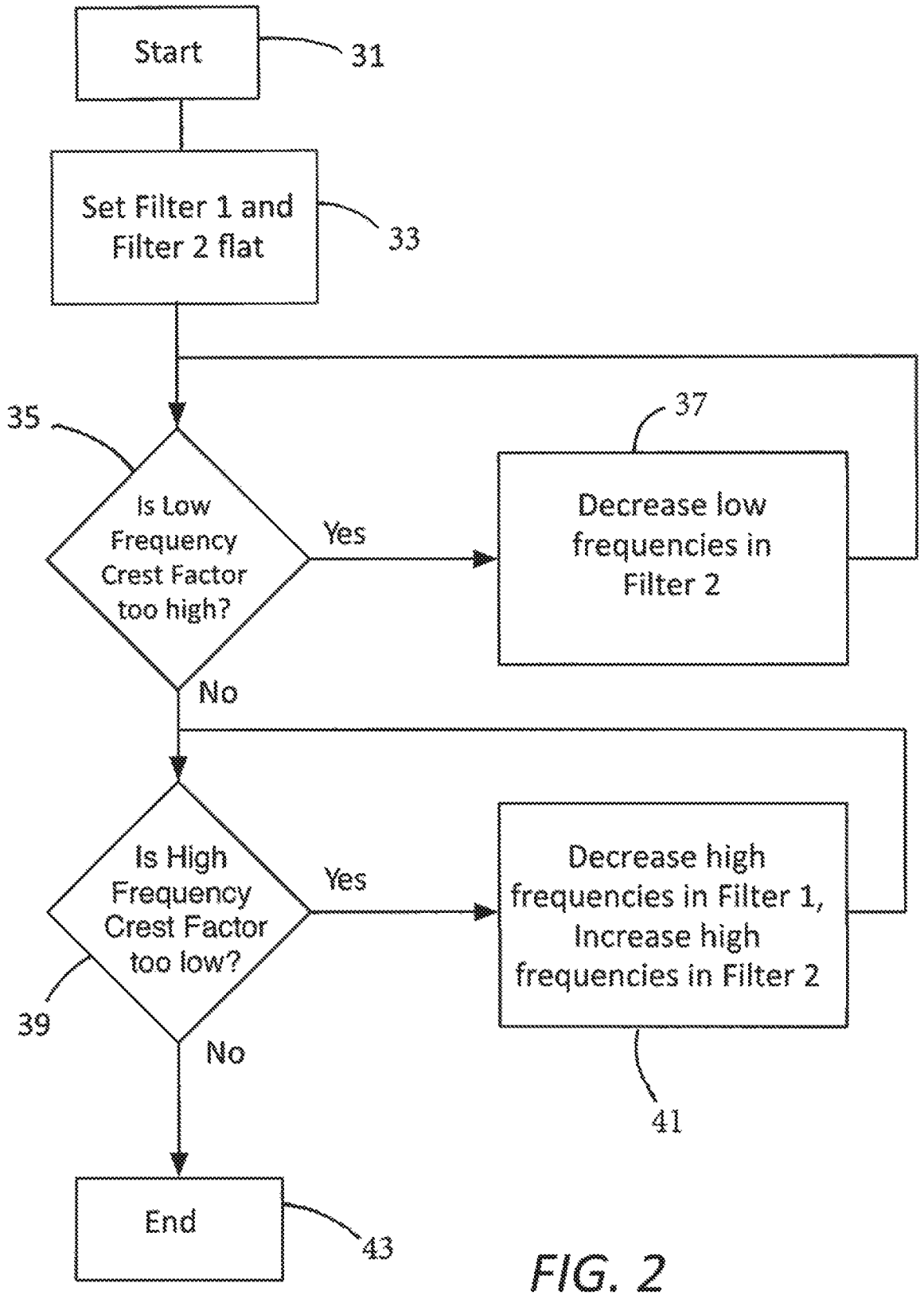
FIG. 2 is a flow chart illustrating the method of the invention.

The method of configuring Filters 1 and 2 to achieve the desired composite noise signal is illustrated in FIG. 2. To start (block 31), Filters 1 and 2 are set flat as represented by block 33. It is then determined if the low frequency crest factor of the composite output noise signal is too high (block 35). If "yes," the energy in the low frequencies of the composite output can be decreased by adjusting Filter 2 in the impulse noise path (block 37). The gain in this signal path (Gain 1) could also be increased. The filter and/or gain adjustments are made until the crest factors at low frequencies (generally below 500 to 1000 Hz) are at levels reflective of the low frequency crest factor of the kinds of live signals that will be reproduced by the loudspeakers under test. Again, this could, for example be crest factors in the range of 13 dB or lower.

If the answer is "no" at decision point 37, that is, if the low frequency crest factor in the composite signal is not too high, it is next determined whether the high frequency crest factor is too low as indicated by decision block 39.

If at decision point 39 the answer is "yes," that is, if the high frequency crest factor is too low, both Filter 1 and Filter 2 can be adjusted. In addition, adjustments could be made to the gain in the impulse signal path (Gain 2) and/or the average firing rate to the impulsive noise source 15. Filter 1 can be adjusted such that the high frequencies of broad band noise in the first signal path 17 are decreased; Filter 2 can be adjusted such that high frequency energy in second signal path 19 (impulse noise path) gradually increases at high frequencies (block 41). In conjunction with these filter adjustments, Gain 2 can be increased and/or the average firing rate of the impulsive noise can be decreased to achieve the contemplated very high crest factors needed at the highest frequencies (e.g. in the range of 20-30 dB).

If and once the answer is "no" at decision point 39, the configuration of the configurable and adjustable parameters of the noise generator is complete, that is, is at an end as indicated by block 43. It will be understood that the above-described configuration steps can be performed in any order.

While the present invention has been described in considerable detail in the foregoing specification and the accompanying drawings, it is understood that it is not intended that the invention be limited to such detail as necessitated by the following claims. For example, the controllable parameter for the two noise sources (broadband noise and impulsive noise) can be configured or set to achieve crest factor increases over the operating broad band of frequencies within ranges other than indicated above. The controllable parameters could be configured or set to produce lower or higher crest factors crest factors at low frequencies or higher or lower crest factors at the upper ranges of crest factors at high frequencies. Also, the increase in the crest facto with frequency could be something other than a monotonic increase, though a monotonic increase would be preferred.

We claim:

1. A noise generator for generating a test signal for measuring the performance of a loudspeaker over an operating broad band of frequencies ranging from low to high frequencies, said noise generator comprising:

a broadband noise source for generating broadband noise over the operating broad band of frequencies, an impulsive noise source for generating random impulses of noise, means for equalizing the broadband noise generated by the broadband noise source, and means for equalizing the random noise impulses, wherein the equalized broadband noise and the equalized randomly generated noise impulses are combined into a composite noise signal and wherein the broadband noise and the randomly generated noise impulses can be equalized to produce a composite noise signal having a desired crest factor versus frequency over the operating broad band of frequencies.

2. The noise generator of claim 1 wherein the broadband noise and the randomly generated noise impulses are equalized to produce a composite noise signal having a crest factor that increases with frequency.

3. The noise generator of claim 1 wherein the broadband noise source generates broadband pink noise.

4. The noise generator of claim 1 wherein the means for equalizing the broadband noise generated by the broadband noise source is configured to reduce an average level of broadband noise at high frequencies within the broad band of frequencies to thereby increase the crest factor of the composite noise signal at high frequencies.

5. The noise generator of claim 1 wherein the means for equalizing the random noise impulses generated by the impulsive noise source is configured to reduce an energy level in the noise impulses at low frequencies.

6. The noise generator of claim 1 further comprising means for controlling an average rate at which noise impulses are generated while preserving a randomness of the rate.

7. A noise generator for generating a test signal for measuring the performance of a loudspeaker over an operating broad band of frequencies ranging from low to high frequencies, said noise generator comprising:

a first noise signal path having a broadband noise source for generating broadband noise over the operating broad band of frequencies, and having a filter configured to set a desired level of broadband noise over the operating broad band of frequencies, a second noise signal path having an impulsive noise source for randomly generating noise impulses, and having a filter configured to set an energy level in the noise impulses within the operating broad band of frequencies, and gain controls for setting gain in the first and second signal paths, wherein a desired crest factor can be established as a function of frequency in a combined noise signal from the first and second noise signal paths by setting and configuring at least one of the gain controls and filter configurations in both the first and second signal paths, and wherein such settings and configurations are established such that the crest factor of the combined noise signal increases with frequency.

8. The noise generator of claim 7 wherein the filter in the first noise signal path is configured to reduce an average level of broadband pink noise produced by the broadband noise source at high frequencies within the operating broad band of frequencies.

9. The noise generator of claim 7 wherein the filter in the second noise signal path is configured to reduce an energy level in the noise impulses produced by the impulsive noise source at low frequencies within the operating broad band of frequencies.

10. The noise generator of claim 7 wherein the impulsive noise generator generates noise impulses at a random rate but the impulsive noise generator is configurable for controlling an average rate at which noise pulses are generated.

11. The noise generator of claim 7 wherein the broadband noise source in the first signal path generates pink noise.

12. A noise generator for generating a test signal for measuring the performance of a loudspeaker over an operating broad band of frequencies ranging from low to high frequencies, said noise generator comprising:

a first noise signal path having a broadband source of pink noise over the operating broad band of frequencies, and having a filter configured to reduce an average level of the broadband pink noise at high frequencies within the operating broad band of frequencies, a second noise signal path having an impulsive noise source that randomly generates noise impulses, said second noise signal path further having a filter configured to reduce an energy level in the randomly generated noise impulses at low frequencies within the operating broad band of frequencies, said impulsive noise source further being configurable for controlling an average rate at which impulsive noise is generated, and gain controls for setting gain in the first and second signal paths, wherein at least one of the following controllable parameters in each of the first and second noise signal paths is controllable to produce a composite noise signal output from the noise generator that has a crest factor that increases with frequency:

i) in the first noise signal path, the filter and gain control;

ii) in the second signal path, the filter, the gain control and the average rate at which the noise impulses are generated.

13. The noise generator of claim 12 wherein the controllable parameters in each of the first and second noise signal paths are set or configured to produce a composite noise signal output from the noise generator that has a crest factor that gradually increases with frequency.

14. The noise generator of claim 12 wherein the controllable parameters in each of the first and second noise signal paths are set or configured to produce a composite noise signal output from the noise generator that has a crest factor that increases to at least about 20 dB at the highest frequency range within operating broad band of frequencies.

15. A method of measuring the performance of a loudspeaker over an operating broad band of frequencies ranging from low to high frequencies, comprising:

generating broadband noise over the operating broad band of frequencies, randomly generating impulses of noise, separately equalizing the broadband noise and random noise impulses, combining the equalized broadband noise and equalized random noise impulses into a composite test signal having a crest factor, and driving the loudspeaker to be measured with the composite test signal, wherein the broadband noise and random noise impulse are equalized such that the crest factor for the test signal increases with frequency.

16. The method of claim 15 wherein the generated broadband noise is broad band pink noise.

17. The method of claim 15 further comprising the step of controlling an average rate at which random noise impulses are generated while preserving a randomness of the rate.

18. The method of claim 15 wherein the broadband noise is equalized so as to reduce a level of broadband noise at high frequencies within the operating broad band of frequencies.

19. The method of claim 15 wherein the random noise impulses are equalized so as to reduce an energy level in the random noise impulses at low frequencies within the operating broad band of frequencies.

20. The method of claim 15 wherein the random noise impulses are equalized so as to increase an energy level in the random noise impulses at high frequencies within the operating broad band of frequencies.

21. A method of measuring the performance of a loudspeaker over an operating broad band of frequencies ranging from low to high frequencies, comprising:

generating broadband pink noise over the operating broad band of frequencies, randomly generating impulses of pink noise, combining the broadband noise and random noise impulses into a composite test signal having a crest factor, equalizing the broadband noise, equalizing the random noise impulses, and driving the loudspeaker to be measured with the composite test signal, wherein the broadband noise and random noise impulse are equalized such that the crest factor for the test signal gradually increases with frequency over the operating frequency range.

* * * * *